US011602250B2

(12) United States Patent
Brinson, III

(10) Patent No.: US 11,602,250 B2
(45) Date of Patent: Mar. 14, 2023

(54) VAC-CANISTER

(71) Applicant: Joseph Brinson, III, Greensboro, NC (US)

(72) Inventor: Joseph Brinson, III, Greensboro, NC (US)

( * ) Notice: Subject to any disclaimer, the term of this patent is extended or adjusted under 35 U.S.C. 154(b) by 405 days.

(21) Appl. No.: 16/840,379

(22) Filed: Apr. 4, 2020

(65) Prior Publication Data

US 2021/0307576 A1 Oct. 7, 2021

(51) Int. Cl.

| | |
|---|---|
| ***A47L 7/00*** | (2006.01) |
| ***A47L 7/02*** | (2006.01) |
| ***B65F 1/14*** | (2006.01) |
| ***B65F 1/12*** | (2006.01) |

(52) U.S. Cl.

CPC ..... *A47L 7/0047* (2013.01); *A47L 7/02* (2013.01); *B65F 1/125* (2013.01); *B65F 1/1452* (2013.01); *B65F 2210/188* (2013.01)

(58) Field of Classification Search

CPC ..... A47L 7/0047; A47L 7/02; A47L 5/225; A47L 9/0018; A47L 9/2873; A47L 13/52; A47L 13/51; B65F 1/125; B65F 1/1452; B65F 2210/188

See application file for complete search history.

(56) References Cited

U.S. PATENT DOCUMENTS

| | | | | | |
|---|---|---|---|---|---|
| 5,953,788 | A * | 9/1999 | Douglas | A47L 5/38 | 15/310 |
| 6,671,924 | B1 * | 1/2004 | Rood | A47L 5/38 | 15/301 |
| 2009/0183333 | A1 * | 7/2009 | Tsai | A47L 7/0047 | 15/310 |
| 2011/0247170 | A1 * | 10/2011 | Jones | A47L 7/0047 | 15/347 |
| 2014/0130293 | A1 * | 5/2014 | Lee | A47L 9/0036 | 15/347 |
| 2014/0215750 | A1 * | 8/2014 | Schultz | A47L 5/225 | 15/323 |

FOREIGN PATENT DOCUMENTS

| | | | |
|---|---|---|---|
| GB | 2463294 | * | 3/2010 |
| KR | 20120076259 A | * | 7/2012 |
| KR | 20200008191 A | * | 1/2020 |
| WO | WO2016040601 | * | 3/2016 |

* cited by examiner

*Primary Examiner* — David Redding
(74) *Attorney, Agent, or Firm* — Tuggle Duggins P.A.; Blake P. Hurt

(57) ABSTRACT

A vacuum-canister that combines the vacuum, dustpan, and trashcan all in one is disclosed herein. The vacuum-canister saves time by allowing the completion of multiple tasks simultaneously. The vacuum-canister can suction both large and small items. Small items are suctioned through the wand extension feature into the dust and trash filter bin. Some larger items can be suctioned through the dustpan and carried to the dust and trash filter bin. Other larger items that are not suctioned can be delivered to the trashcan automatically. The functionality of the vacuum-canister not only saves time, but also minimizes potential aches and pains as a result of daily manual cleaning activities.

1 Claim, 10 Drawing Sheets

VAC-CANISTER

FIELD OF INVENTION

The related field of invention is the vacuum cleaner, and in particular to the suction and disposal with additional functions for a vacuum cleaner.

The present disclosure is specifically geared towards a combination of unique cleaning functionality, which includes multiple ways to remove unwanted trash from the floor. For example, the suction of the vacuum is usually limited to the floor of the vacuum or the hose of the vacuum and one method of disposal of those contents. The present disclosure is not limited to the two forms of suction nor is it limited to one method of disposal.

BACKGROUND OF THE INVENTION

It is common that a vacuum cleaner has dual functionality for suctioning items. The dual functionality is used to improve cleaning performance but is limited by the size of the items that can be received.

Although the typical vacuum cleaner can be used to pick up trash, large items cannot be suctioned without causing damage to the vacuum.

SUMMARY OF THE INVENTION

It is an aspect of the present disclosure to provide a more diversified method to cleaning, particularly by allowing the disposal of larger items with minimal manual labor.

The present disclosure provides a vacuum-canister that makes cleaning easier for individuals by combining the vacuum, dustpan, and trashcan all in one device. The vacuum canister can suction large items through the dustpan without damaging the vacuum. Items can also be discarded automatically via the attached dustpan without use of the vacuum.

The vacuum-canister saves time by allowing multiple tasks to be completed at one time. Provides convenience for daily tasks by providing quick and compact ways to clean.

The present disclosure also addresses concerns of individuals with lower back pain and/or injuries. The present disclosure also provides assistance to individuals with limited mobility by performing multiple tasks at once and by reducing the number of manual functions usually needed to complete tasks.

BRIEF DESCRIPTION OF DRAWINGS

Components of the present disclosure will now be described by way of drawings and detailed examples.

DETAILED DESCRIPTION OF DRAWINGS

Figure 1:
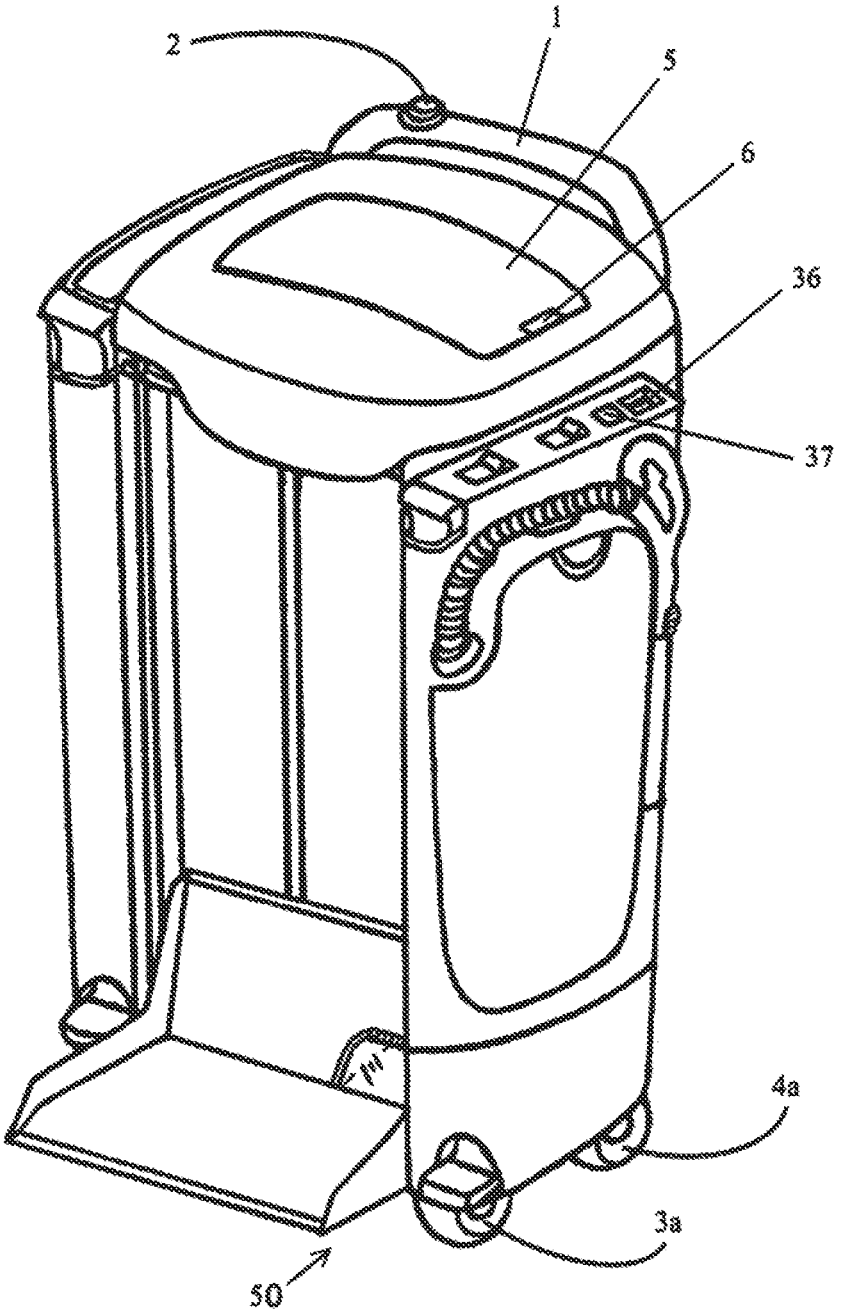
FIG. 1 is a perspective view of the multipurpose vacuum-canister.

FIG. 1: Multipurpose Vacuum-Canister with Handle and Wheels

1. The handle (1) is on the backside of the vacuum-canister near the top of the vacuum-canister:

a) Handle (1) with button (2) extends by pulling handle (1) upward when button (2) is pressed.

2. Wheels (3*a*, 3*b*, 4*a*, 4*b*) are located on the bottom (50) of the vacuum-canister:

a) Front swivel wheels (3*a*) and (3*b*) allow for easy mobility of the vacuum-canister, and the rear stationary wheels (4*a*) and (4*b*) provide control and stability as the vacuum-canister is moved to a variety of different areas for cleaning, without hassle.

Figure 2:
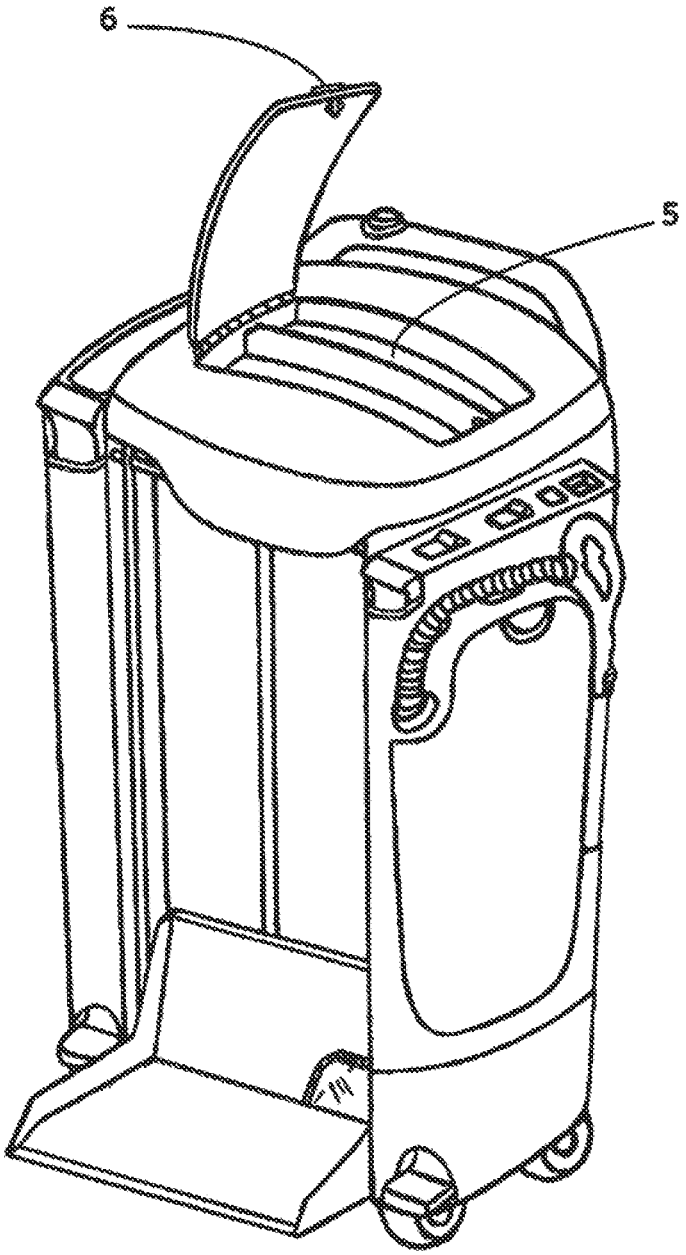
FIG. 2 is a perspective view of the lid storage compartment used to store accessories for the vacuum component.

FIG. 2: Top Lid-Storage Compartment

1. Extra accessories/attachments may be stored in the top lid-storage compartment (5) of the vacuum-canister. Additional accessories/attachments may be accessed by pressing the top lid compartment latch button (6) on top of the lid.

Figure 3:
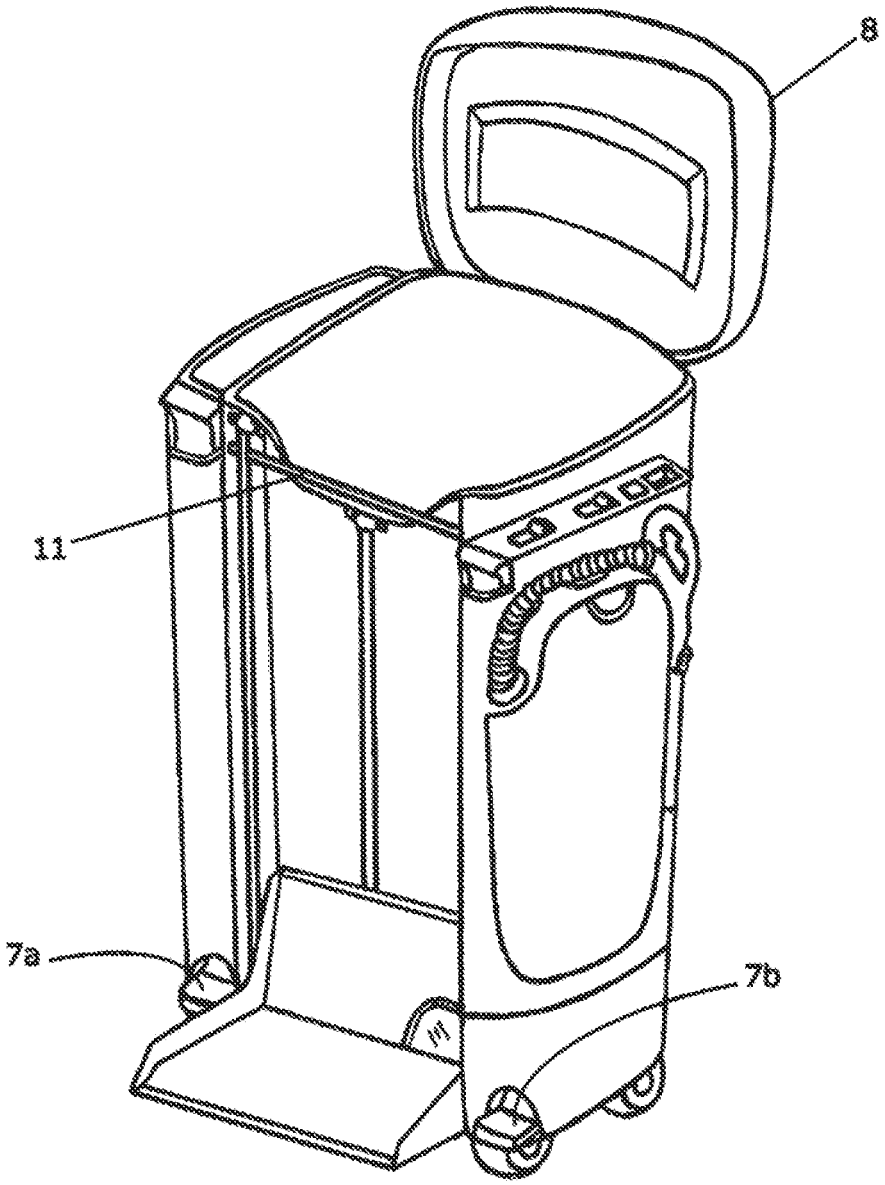
FIG. 3 is a perspective view of the hands-free lid foot operation: controlled by stepping on the foot operation on either side either of the trash can.

FIG. 3: Double-Sided Hands-Free Manual Front Foot Operation

1. The double-sided hands-free front manual foot operation (7*a*) and (7*b*), allows a user to operate the opening and closing of the hands-free lid (8).

a) The lid (8) can be controlled by manually stepping on left (7*a*) or right-side (7*b*) foot operation.

Figure 4:
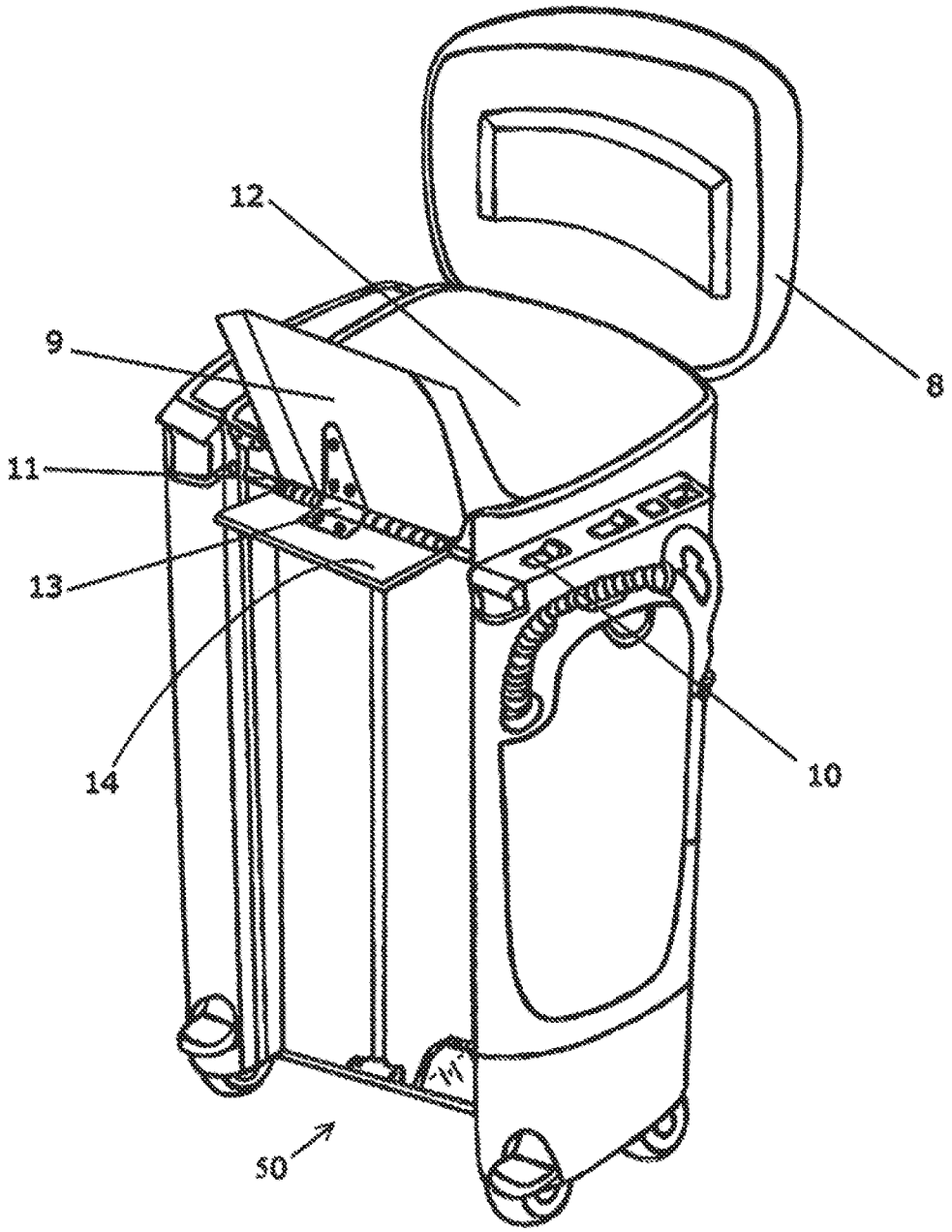
FIG. 4 is a perspective view of the dustpan: the pan button controls the up and down motion of the dustpan, and the pan button also prompts the lid of the vacuum-canister to open once the dustpan reaches the top of the vacuum-canister when discarding contents collected by the dustpan.

FIG. 4: Double-Sided Dustpan and Pan Button

1. Attached to the vacuum-canister is a dustpan (9), which is one of the unique features of this vacuum-canister. The vacuum-canister has a special pan button (10) as well.

a) The "pan" button (10) is located the top right-hand side of the vacuum-canister. It controls the up and down motion of the dustpan (9); also, it prompts the lid (8) of the vacuum-canister to open once the dustpan (9) reaches the top of the vacuum-canister. When the dustpan (9) is located at the bottom (50) of the vacuum-canister, pressing the pan button (10) will cause the dustpan (9) to move up the vacuum-canister. Once the dustpan reaches a certain level the lid (8) of the vacuum-canister will automatically open and the flipping pole (11) near the top of the vacuum-canister, will flip the double-sided dustpan (9) inward towards the trashcan (12) causing the contents to be transferred from the first side of the dustpan (9) onto the second side to discard the contents. The dustpan (9) is prevented from falling into the trashcan (12) by hinge (13) connected to the dustpan platform (14). Once the contents are discarded, the dustpan (9) then returns to the bottom (50) of the vacuum-canister in the stationary position.

Figure 5:
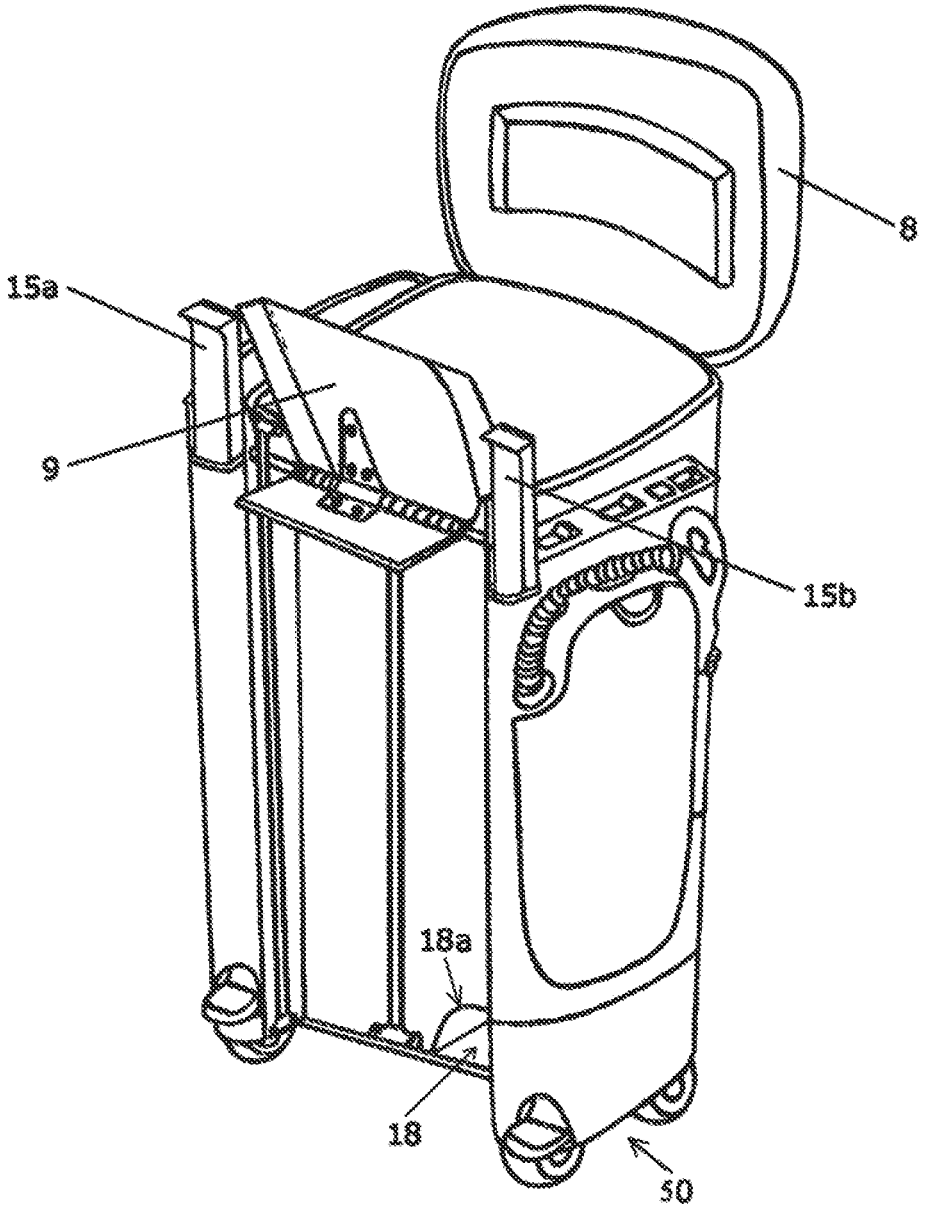
FIG. 5 is a perspective view of the dual-sided dustpan handle: the dual-sided dustpan handle facilitates manual emptying of the dustpan, as may be necessary when the vacuum-canister needs to be charged.

FIG. 5: Manual Dual-Sided Dustpan Handle

1. Double-sided dustpan handle (15*a*) and (15*b*);

a) Allows the dustpan (9) to be manually emptied when the device needs to be charged, and b) By lifting the manual dustpan handle on the left side (15*a*), or the manual dustpan handle on the right side (15*b*), the user may dispose of trash and lid (8) will open as dustpan (9) nears the top of the device.

2. Vacuum Hose (18) and vacuum opening (18*a*);

a) The dustpan has a suction flap (16), the flap (16) of the dustpan (9) is aligned with an opening (18*a*) of vacuum hose (18) when the dustpan (9) is positioned at the bottom (50) of the vacuum-canister.

Figure 6:
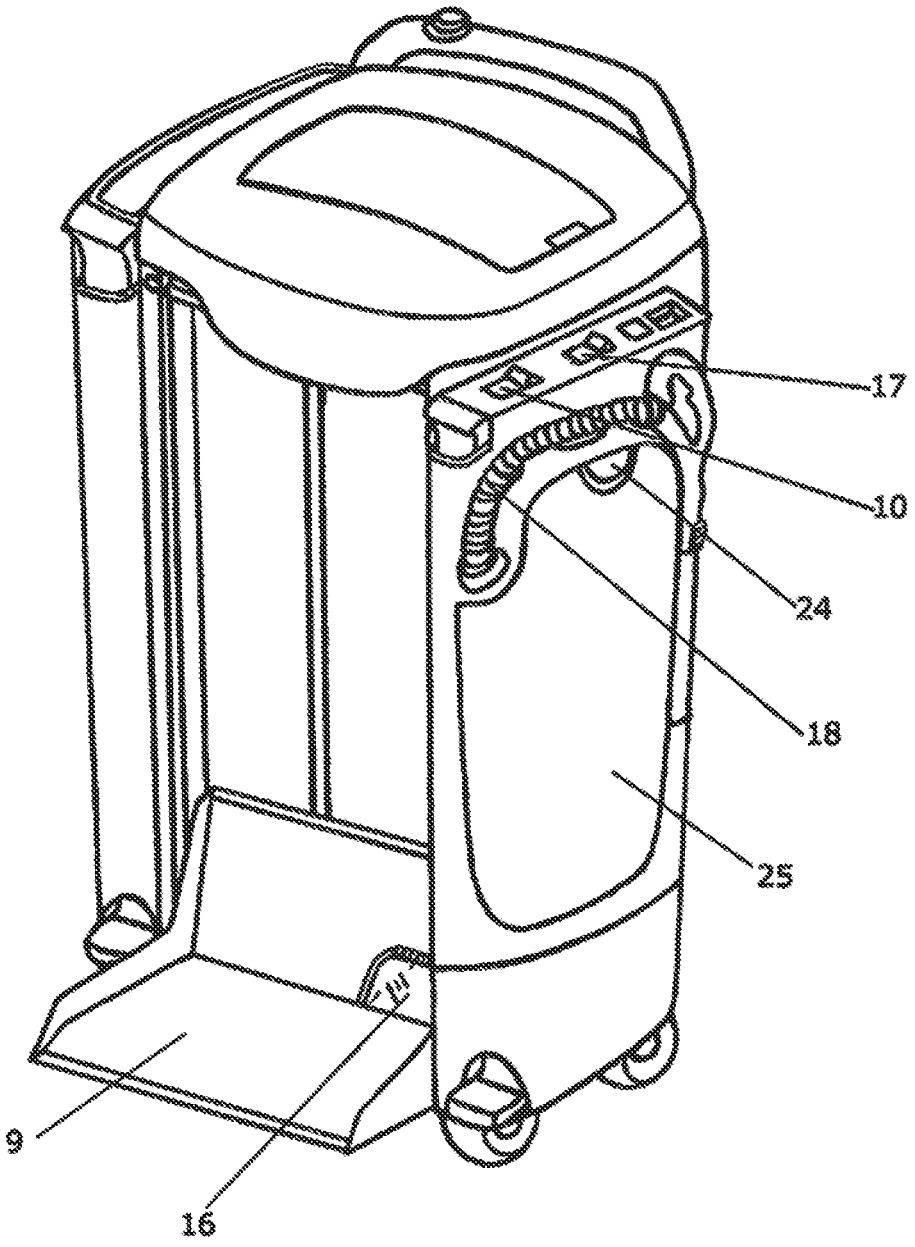
FIG. 6 is a perspective view of the dustpan and shows the dustpan in a stationary position at the bottom of the vacuum-canister. In the stationary position, the dustpan has a full vacuum suction functionality that is activated when the "vac button" is pressed.

FIG. 6: Dustpan with Suction Flap/"Vac" Button

The dustpan (9) has a suction flap (16), which is another unique feature of this vacuum-canister. When the dustpan (9) is in the stationary position at the bottom (50) of the vacuum-canister, the vacuum-canister has full vacuum suction functionality. This vacuum suction functionality is activated when the "vac button" (17) is pressed. The flap (16) of the dustpan (9) that is aligned with the vacuum hose (18) opens allowing contents that are manually swept onto the dustpan (9) to be suctioned. For items that are too large to be suctioned through the vacuum hose (18), the user may dispose of the remaining contents on the dustpan (9) by pressing the "pan button" (10).

Figure 7:
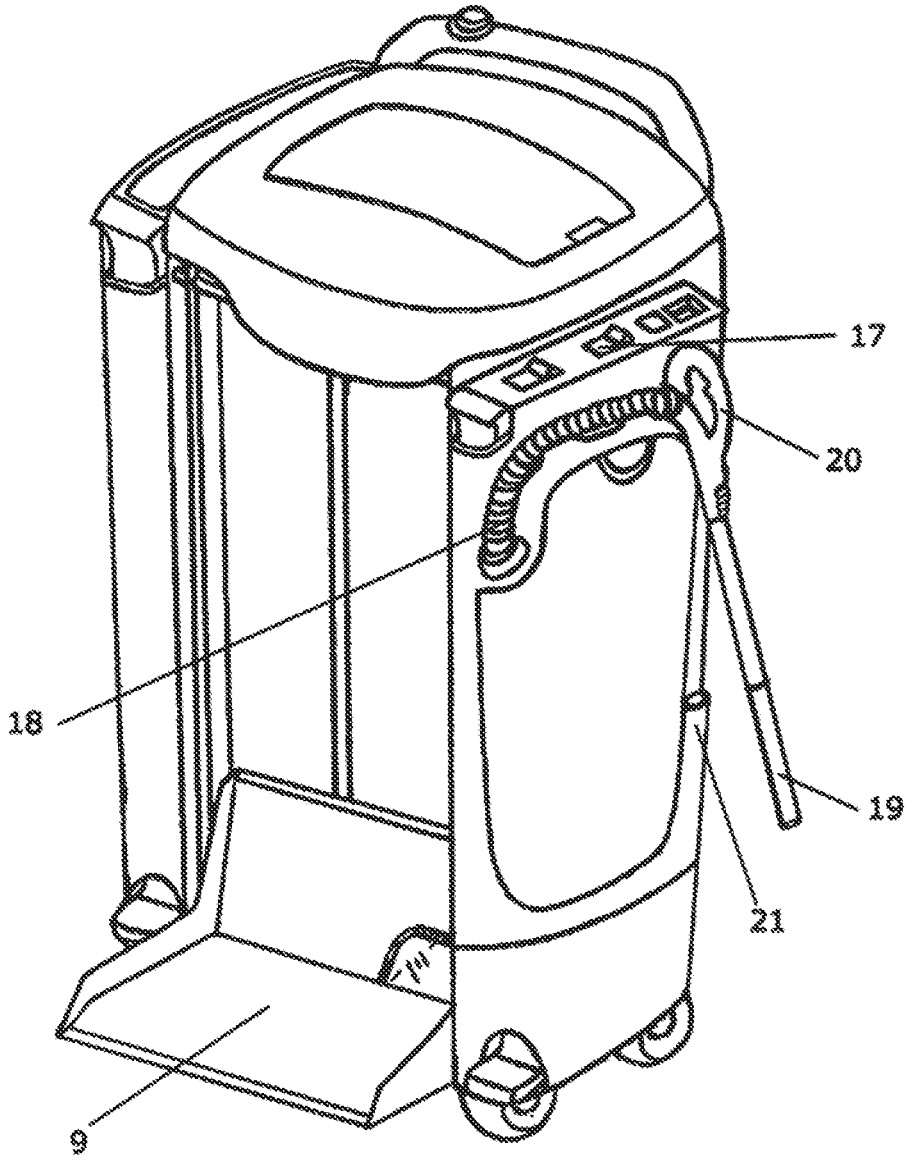
FIG. 7 is a perspective view of the handheld vacuum wand: the wand may be used to gather dust and trash from small spaces, cracks, and crevices.

FIG. 7: Handheld Vacuum Wand with Hose

1. The handheld vacuum wand (19) is used to gather dust and trash from small spaces, cracks, and crevices.

a) A user may use the handheld vacuum wand (19) by grabbing the handle (20) of the vacuum wand (19) and lifting vacuum wand (19) from its designated slot (21). The removal of the vacuum wand (19) automatically transfers the suction from the dustpan (9) to the wand (19) when the "vac" button (17) is pressed by the user to the "on" configuration.

b) Pressing the "Vac" button (17) will control suction through the vacuum wand (19) and hose (18) and trash and dust will be disposed into the dust and trash filter bin (22).

Figure 8:
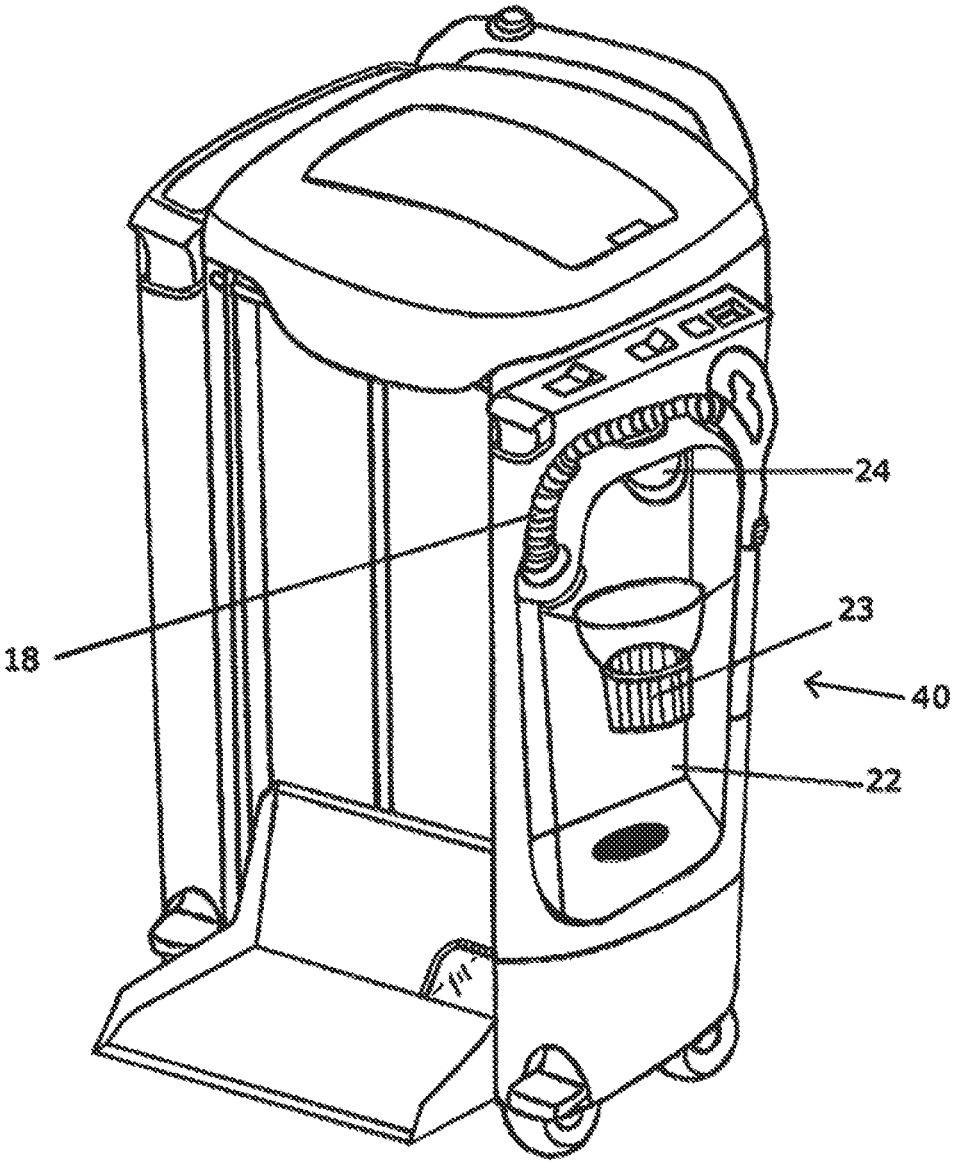
FIG. 8 is a perspective view of the vacuum components, specifically the dust and trash filter: the dust and trash filter collects the dust and trash that is suctioned through the vacuum hose.

FIG. 8: Dust/Trash Filter Bin

The vacuum (40) includes a dust filter (23) inside of the dust and trash filter bin (22) that collects the dust and trash that is suctioned through the vacuum hose (18).

a) The dust and trash filter bin (22) can be emptied by pulling up on the vacuum door latch (24) which provides access to the filter bin (22) so that dust and trash collected during use can manually be disposed of. Once emptied, a user may place bin (22) with dust filter (23) back into the compartment. Once the vacuum door (25) as seen in FIG. 6 is closed, the latch (24) will lock in place, keeping the dust and trash filter bin (22) secure.

Figure 9:
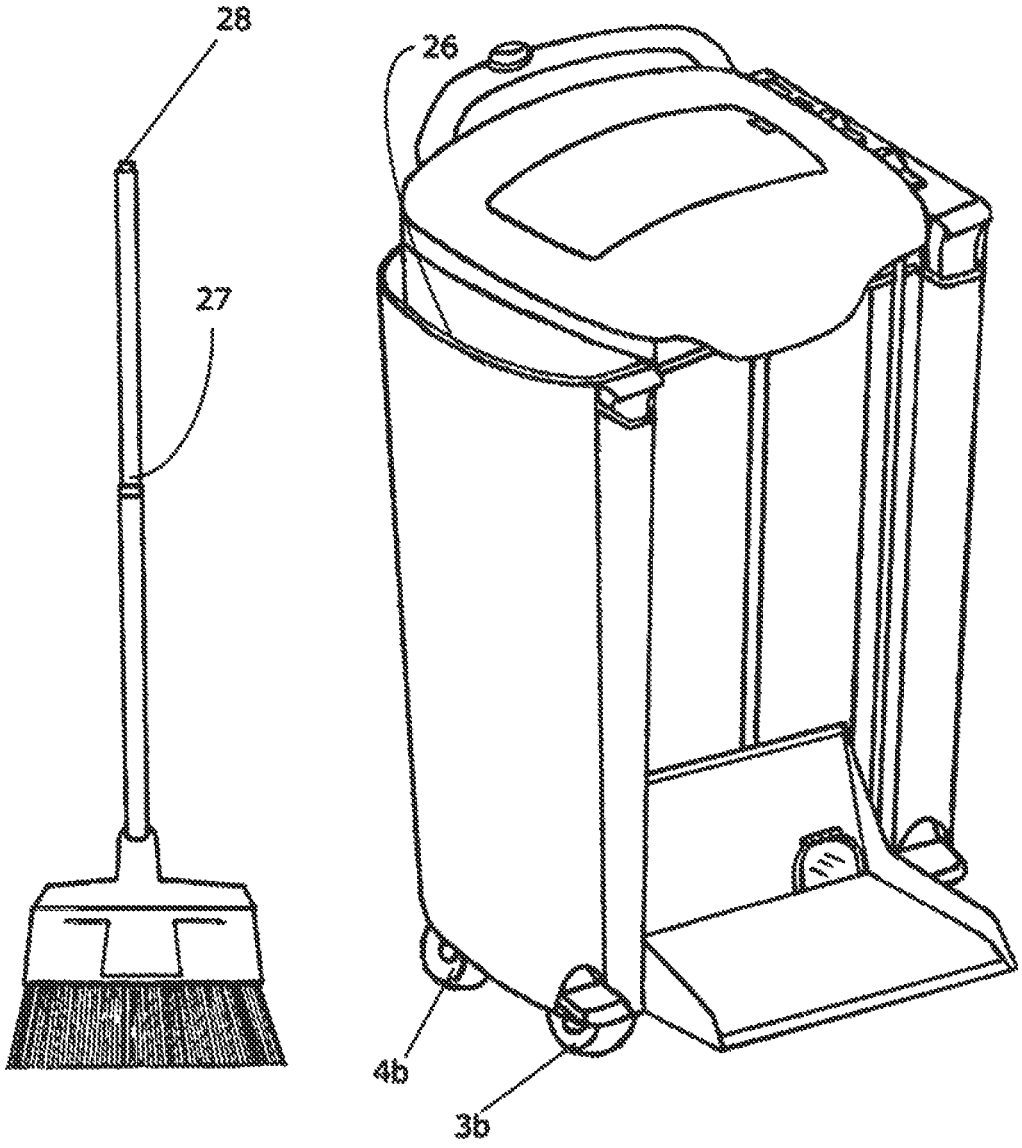
FIG. 9 is a perspective view of the broom compartment and the adjustable broom: the adjustable broom may adjust to multiple sizes and will be included with the vac-canister for the option of manual use.

FIG. 9: Adjustable Broom & Broom Storage Compartment

1. The vacuum-canister includes a broom compartment (26) that includes an adjustable broom (27) for the option of manual use by a user for sweeping.

a) Left side broom compartment (26) is where larger cleaning tools such as an adjustable broom (27) or similar cleaning tools may be stored.

2. The adjustable broom (27) may be adjusted to multiple lengths.

a) The adjustable broom (27) includes an adjustment button (28) on the top of the broom (27). When the button (28) is pressed it facilitates the adjustment of the broom (27) to adjust to a variety of different lengths.

Figure 10:
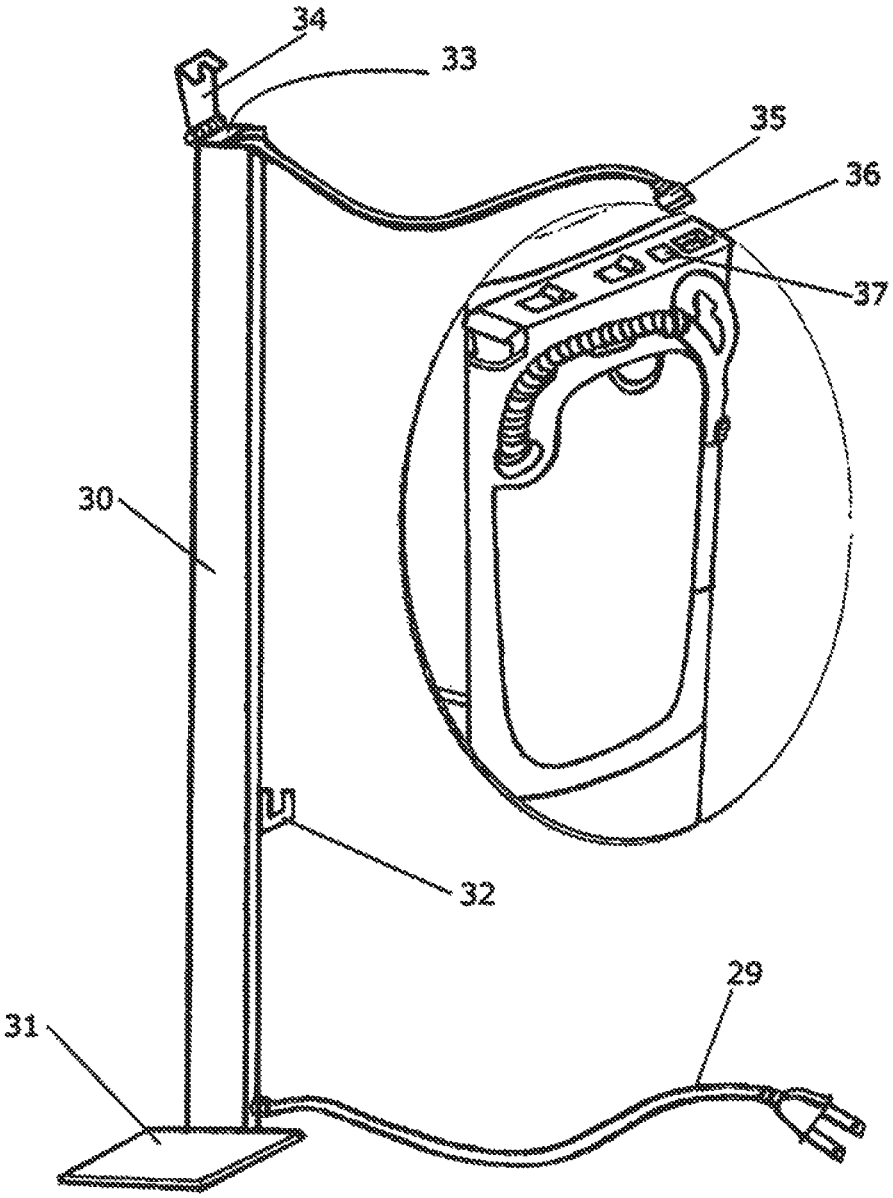
FIG. 10 is a perspective view of the charging tower station: the charging tower station provides full charge for optimal use of the vacuum-canister.

FIG. 10: Charging Station

Charging Tower Station (30):

a) The power cord (29) is attached to the charging tower station (30) which is located near the bottom base (31) of the charging tower station (30). For optimal use, a user may plug power cord (29) from the charging tower station (30) into a wall outlet. In situations when the full length of the power cord (29) is not being used, the charging tower station (30) has a U-hook (32) that the excess power cord (29) can be stored on.

b) The charging cord storage compartment (33) located at the top of the charging tower has a lid cover (34) that opens up and provides access to the charging cord with magnetic charging end (35). The charging cord (29) with magnetic charging end (35) may be removed from the top of the charging tower, and the magnetic charging end (35) may be plugged into top charging slot (36) on the vacuum-canister. The charging slot (36) is located on the right-hand side of the vacuum-canister, directly behind the "pan" button (10) and the "vac" button (17). The charging light (37) will illuminate once the vacuum-canister begins charging.

c) Once fully charged, a user may unplug magnetic charging end (35) and place the charging cord (29) back into the designated spot on charging tower (30), the vacuum-canister is now ready for full use.

The invention claimed is:

1. A vacuum-canister comprising:

a trashcan (12) configured to receive items, the trashcan (12) comprising a vacuum (40), the vacuum (40) integrally formed with the trashcan (12), the vacuum (40) including a vacuum hose (18), the vacuum (40) configured to deposit items received via the vacuum hose (18) into the trashcan (12);

a dustpan (9) configured to be attachable to the vacuum-canister, the dustpan (9) oriented to travel vertically along the vacuum-canister when actuated, the dustpan (9) comprising a flap (16);

wherein, the dustpan (9) is configured so that when the dustpan (9) is positioned at a bottom (50) of the vacuum-canister, the flap (16) is aligned with an opening (18*a*) of the vacuum hose (18); and wherein, the flap (16) is configured to displace from the opening (18*a*) of the vacuum hose (18) when the vacuum (40) is activated facilitating the receipt of items through the vacuum hose (18).

* * * * *